US006053217A

United States Patent [19]

Schuh

[11] Patent Number: 6,053,217

[45] Date of Patent: Apr. 25, 2000

[54] METHOD OF LEVELING AND COMPACTING CANDLE WAX

[76] Inventor: Joseph F. Schuh, 509 E. Kimberly Ave., Kimberly, Wis. 54136

[21] Appl. No.: 09/317,731

[22] Filed: May 24, 1999

Related U.S. Application Data

[60] Provisional application No. 60/116,031, Feb. 22, 1999.

[51] Int. Cl.[7] ..... B65B 1/20

[52] U.S. Cl. ..... 141/80; 141/71; 141/82; 141/11; 425/803; 425/469; 264/322

[58] Field of Search ..... 428/131; 81/436, 81/489; 173/90, 131, 1; 141/80, 82, 11, 71, 73; 425/803, 469; 264/322

[56] References Cited

U.S. PATENT DOCUMENTS 3,716,081 2/1973 Landreville ..... 141/12
5,816,338 10/1998 Fleming ..... 172/381

FOREIGN PATENT DOCUMENTS 8608150 4/1987 South Africa .

*Primary Examiner*—Ellis Robinson
*Assistant Examiner*—Laura L. Lee

[57] ABSTRACT

A method for leveling and compacting candle wax using is a small, hand held, plastic and wood device to pack or tamp the surface wax of a larger diameter (4') glass-jar candle to an even level.

1 Claim, 4 Drawing Sheets

METHOD OF LEVELING AND COMPACTING CANDLE WAX

CROSS REFERENCE FOR RELATED APPLICATION

Provisional Application Ser. No. 60/116,031, filed on Feb. 22, 1999. Handle has been modified slightly from that filed in Provisional Application.

BACKGROUND OF THE INVENTION

When burning a 4 inch diameter glass-jar candle, as the wick burns down, the outer surface edge of candle along jar wall does not get sufficient heat from flame to keep it melted level with center pool.

As wick descends further, often times the wick becomes flooded by wax run-off from outer edge, which is now higher, causing wick to drown itself out. This can happen at different times in a candle's life, but the result is always the same: The center of candle and wick are essentially used up, while a thick ring of wax around the outside edge of candle is left behind, useless, and thus, wasted.

By tamping candle on a regular basis, after extinguishing, while wax is still warm and pliable, a relatively flat surface level can be maintained, thereby preventing wax run-off and eliminating wick flooding.

A candle which is properly maintained from the first burn through the last, at an even surface level, will literally burn itself out, evenly, until all wax is used up in its entirety wasting none.

There will be no thick ring of wax around jar wall, as all wax will have been made to stay at wick's level throughout candle's life. This theory has been tested, many times by inventor, and has proven to be true.

While this device is custom designed to be used with the popular 4 inch diameter glass-jar candles sold at most department stores, the curved edge of its base gives it the versatility needed to be used with various styles and sizes.

BRIEF SUMMARY OF THE INVENTION

A method for leveling and compacting candle wax using to tamp surface wax of an extinguished, still warm and pliable glass enclosed candle, to an even level, thereby promoting a uniformed burn and a longer, more productive life of candle.

A rear view of the invention, showing the edge of the base, 1, which is contoured to specifically and precisely fit along outer edge of wax on 4 inch diameter glass-jar candle.

This drawing also identifies the only other two parts of the invention:

The Handle, 2

The Head, 3

FIG. 2:

A front view of the invention, showing coved-out front edge of base, 1. This edge is coved inward to help prevent it from contacting liquid pool of wax immediately surrounding wick. Smiley face on handle head, 3, Smilely face on handle head, 3, will be stenciled permanently on head for cosmetic purpose. will be stenciled permanently on head for cosmetic purposes.

FIG. 3:

A slightly forward, aerial view of invention in use. This view shows candle tamper as it is intended to be used, to push wax down along outer edge of candle where wax meets jar.

Figure 1:
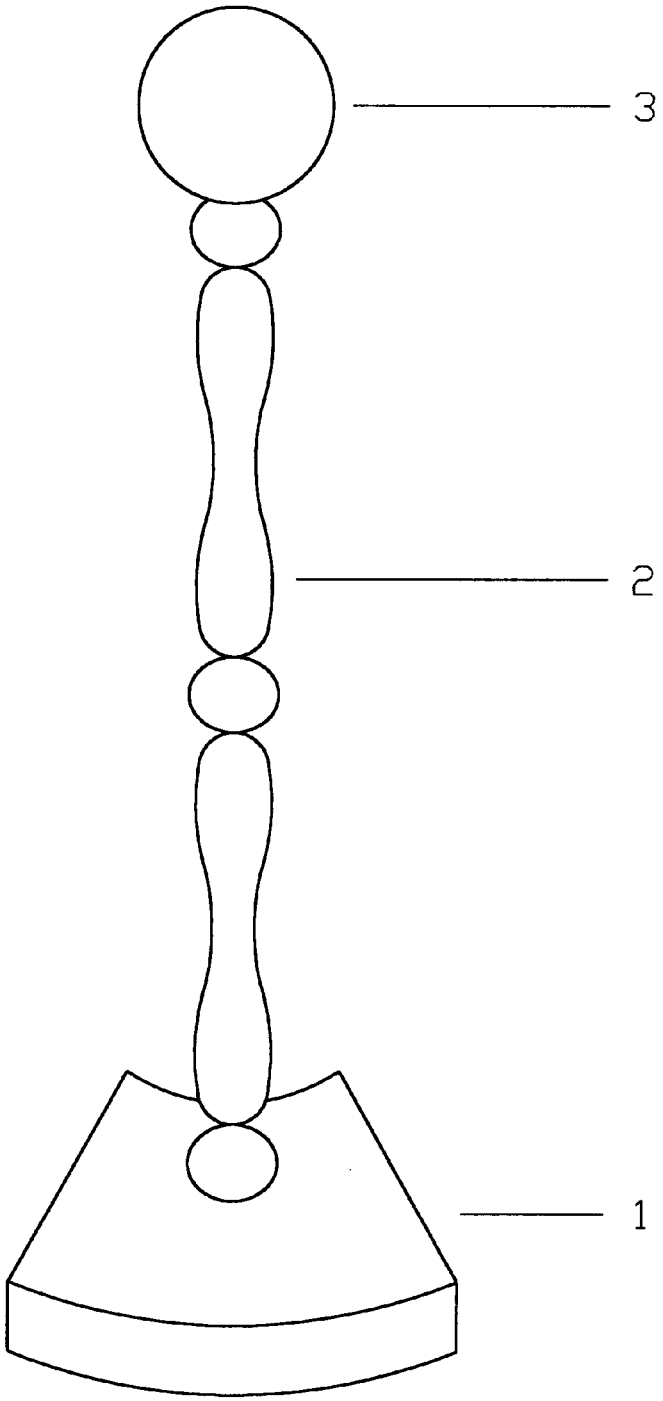
FIG. 1.
Figure 2:
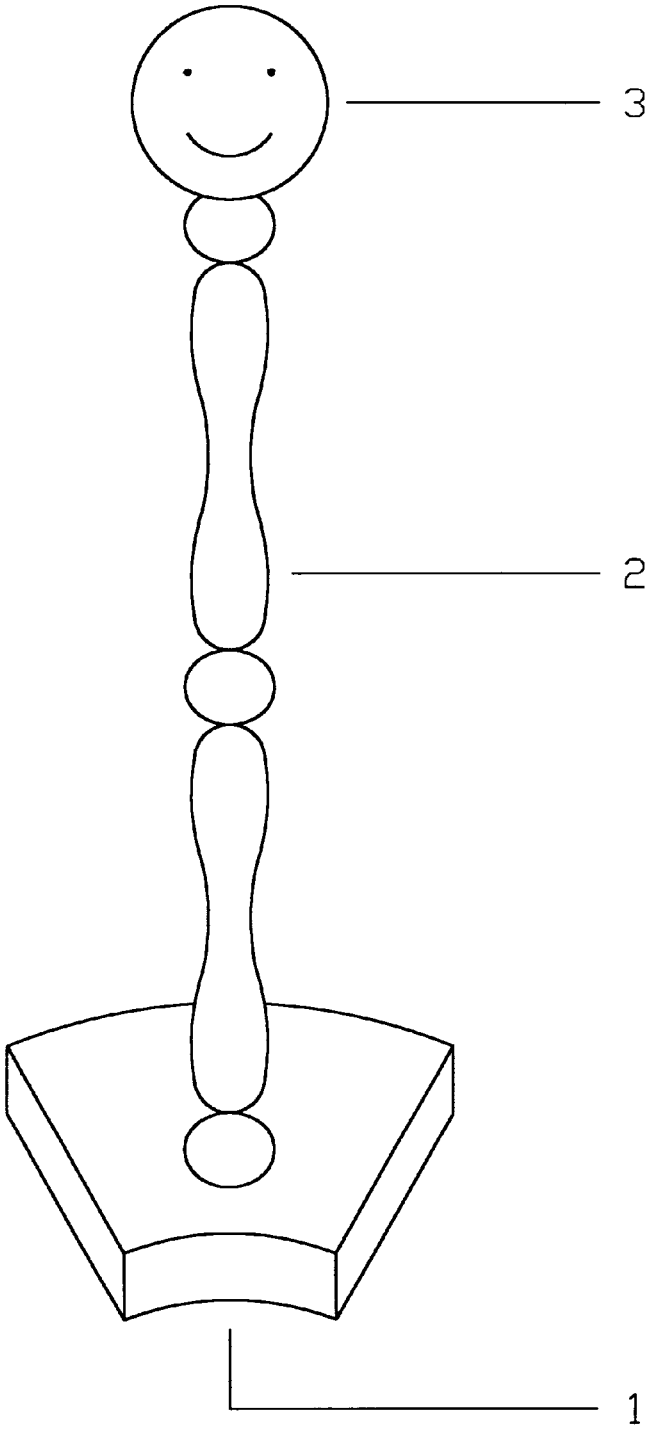
Figure 3:
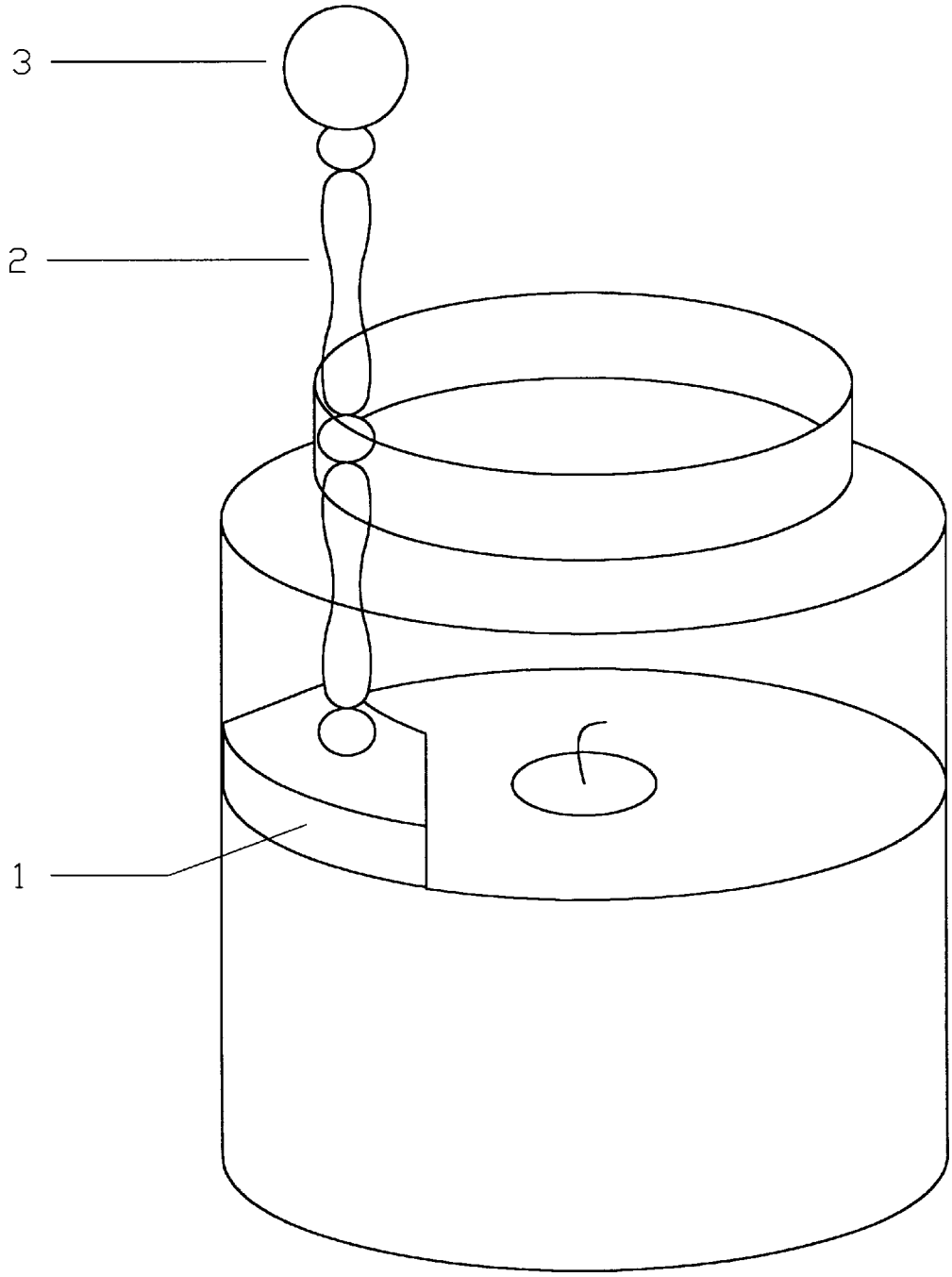
Figure 4:
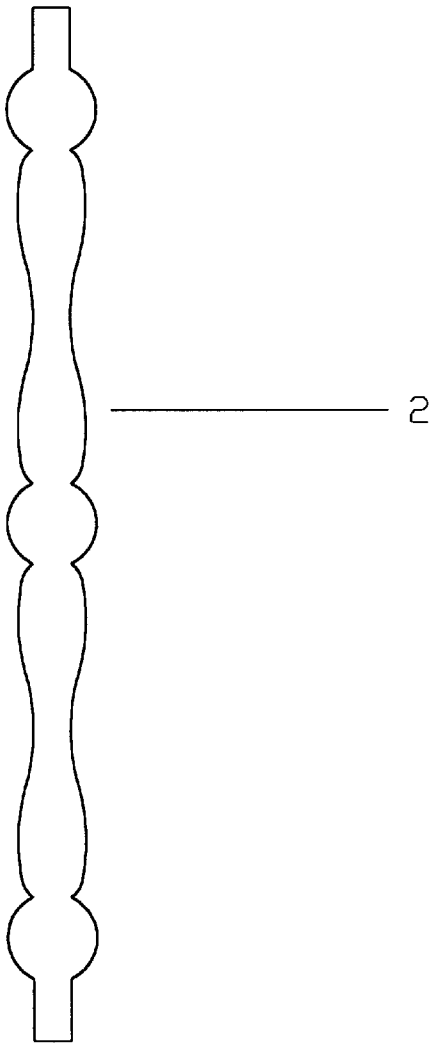
Figure 5:
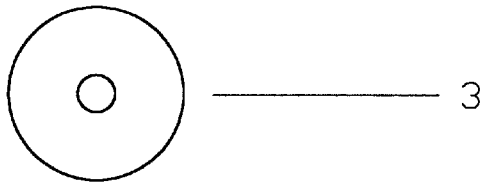
Figure 6:
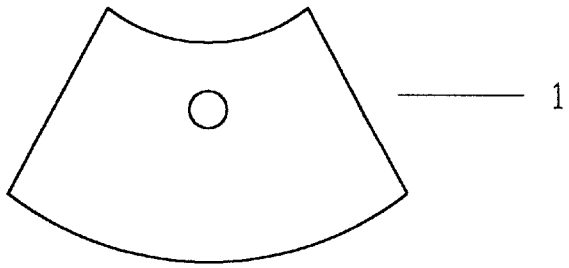

FIGS. 4, 5 and 6:

A drawing of each of the three separate pieces, A drawing of each of the three separate pieces, showing hole in both head and base, where spindle tenon goes in, showing hole in both head and base, where spindle tenon goes in.

DETAILED DESCRIPTION OF THE INVENTION

This device is made of two materials: wood and polyethylene. The base, or actual tamper pad, 1, is constructed of one solid piece of ¼ inch thick polyethylene. It is die-cut from a ¼ inch thick sheet, It is die-cut from a ¼ inch thick sheet. Base measures 1 and ⅞ inches long by 1 and ¼ inches wide.

The handle, 2, is a one piece, hard wood spindle measuring 6 inches long by ½ inch in diameter. It has a ¼ inch tenon on each end, allowing it to be inserted into a hole in both the base, 1, and the head, 3. The base-to-handle fit is simply a pressure fit into a hole, while the wood-to-wood, handle-to-head fit applies the use of carpenters' glue.

The head, 3, is a 1 inch diameter hard wood ball with a ¼ inch hole drilled into its center to receive handle tenon.

I claim:

1. A method of leveling and compacting candle wax in a glass jar comprising the steps of providing: 1) a 4 inch diameter glass-jar candle having a closed end and an open end, with a surface of an extinguished, warm and pliable wax therein; 2) a tamper comprising a base made of a solid piece of polyethylene cut with an outer edge contoured to the shape of the said open end of said glass-jar candle and a handle with a tenon on each end allowing it to be inserted into a hole in middle of the base; 3) inserting the base of the tamper into the open end of the glass-jar candle; and 4) leveling the still warm and pliable wax surface preventing wax run off and eliminating wick flooding.

* * * * *